United States Patent [19]

Brantman

[11] Patent Number: 4,987,621

[45] Date of Patent: Jan. 29, 1991

[54] SLIDING TRANSFER DEVICE

[76] Inventor: Robert F. Brantman, 1400 N. Waukegan Rd., Lake Forest, Ill. 60045

[21] Appl. No.: 519,290

[22] Filed: May 4, 1990

[51] Int. Cl.[5] ..... A61G 7/053; A61G 7/10

[52] U.S. Cl. ..... 5/81 R; 193/35 R

[58] Field of Search ..... 5/81 R, 81 B, 81 C; 193/35 R; 414/921

[56] References Cited

U.S. PATENT DOCUMENTS

| | | | |
|---|---|---|---|
| 799,699 | 9/1905 | Winter | 193/35 R |
| 3,962,736 | 6/1976 | Fedele | 5/81 R |
| 4,259,756 | 4/1981 | Pace | 5/81 B |
| 4,644,594 | 2/1987 | Johnson | 5/81 R |

FOREIGN PATENT DOCUMENTS

| | | | |
|---|---|---|---|
| 722480 | 11/1965 | Canada | 193/35 R |

OTHER PUBLICATIONS

Preston, 1989 Winter Catalog, PC 7087 p. 148.

Fabrication Enterprises Inc., 1988 Catalog, p. 62.

*Primary Examiner*—Alexander Grosz

*Attorney, Agent, or Firm*—Willian Brinks Olds Hofer Gilson & Lione

[57] ABSTRACT

A sliding transfer device comprising a lower support plate and an upper seat. The upper seat is attached to the lower support plate to slide over the top surface of the plate. A person being transferred from one location to another, such as the edge of a bed to a wheelchair seat, is placed upon the upper seat, and is transferred as the seat slides across the top surface of the lower support plate. The lower support plate may be straight or curved.

6 Claims, 2 Drawing Sheets

SLIDING TRANSFER DEVICE

FIELD OF THE INVENTION

This invention relates to a device for transferring a patient from one location to another. More specifically, the invention relates to a sliding device for transferring a patient between two proximate locations such as a bed and a wheel chair.

BACKGROUND OF THE INVENTION

Those with lower extremity disabilities often have difficulty moving from one location to another. Often times these people are confined to a wheel chair and require assistance to transfer between a bed, tub, or commode to a wheel chair or similar device.

Presently, assistance in transferring patients can be provided by transfer boards, which are generally solid, smooth, rectangular-shaped plywood boards, approximately 8 inches wide and 24 to 30 inches long. To move a patient from a bed to a wheel chair, for example, one end of the rectangular transfer board is placed under the patient sitting on the edge of the bed, and the other end of the board is placed on the wheel chair seat. Generally with the assistance of at least one person, the patient slides across the board from the bed toward the wheel chair. The patient then sits on the corner of the wheel chair seat, and makes a half turn, backwards into the wheel chair, as the transfer board is removed.

This operation usually requires considerable strength and effort by the patient. If the patient lacks the required strength, as in the case of a disabled person or some senior citizens, more than one person may be needed to help slide the patient across the transfer board. But, this becomes a problem when the only assistance available is from someone who also is disabled, or more commonly, a senior citizen.

It therefore is an object of the present invention to greatly reduce the amount of assistance required in transferring a patient or invalid between proximate locations. It is further an object of the present invention to reduce the amount of turning the patient must endure in transferring between these locations. These and other objectives are accomplished by the sliding transfer device described.

SUMMARY OF THE INVENTION

The present invention relates to a substantially rectangular or curved sliding transfer device. In one embodiment, the device comprises an upper seat member slidably attached to a lower support plate having a substantially flat top surface. To transfer a patient from a bed to a wheel chair, for example, one end of the lower support plate is placed under the patient at the edge of the bed. The other end is placed on the edge of the wheel chair seat. The upper seat is moved under the patient. The patient sits on the upper seat, and is carried by the seat as it slides across the top surface of the lower support plate toward the edge of the wheel chair seat. At the wheel chair seat, the patient turns backwards into the wheel chair with considerably less difficulty than with presently available boards. The sliding transfer device is then removed from beneath the patient.

In another embodiment, the top surface of the lower support plate is curved or arranged in an arc. To transfer a patient, one end of the lower support plate is placed under the patient and on the edge of the bed, and the other end is placed on the edge of the wheel chair seat. The upper seat is then moved under the patient. In this embodiment, the sliding transfer device is placed between the bed and wheel chair seat so that, as the patient slides across the curvature of the top surface, the patient's back is turned toward the wheel chair back. Thus, in this embodiment, the patient needs to turn only slightly backward into the wheel chair seat, further reducing the difficulty of transferring.

DETAILED DESCRIPTION OF THE DRAWINGS AND PREFERRED EMBODIMENTS

Figure 1:
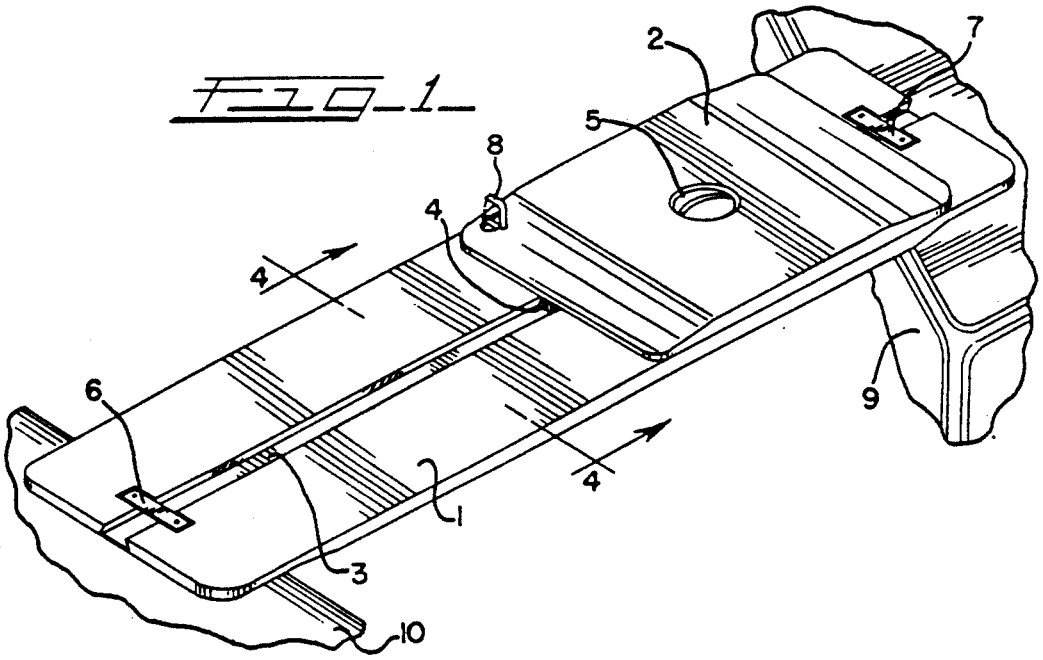
FIG. 1 illustrates a sliding transfer device of the present invention comprising a substantially rectangular lower support plate.
Figure 4:
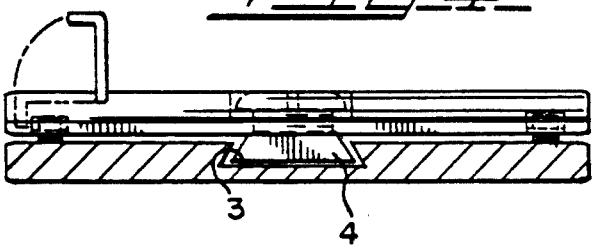
FIG. 4 illustrates a section view of FIG. 1.

FIG. 1 illustrates one embodiment of the sliding transfer device of the present invention. This embodiment comprises a lower support plate 1 having a substantially flat, rectangular top surface, and an upper seat 2. The upper seat is slidably affixed to the lower support member by a track and guide assembly. In this embodiment, track 3 comprises a female recess running the length of the lower support plate. As shown in FIG. 4, a male guide 4 is fixed within the recess track. The male guide may comprise a continuous wedge shaped guide 4 set within the recess track 3. An adjustable tension screw 5 may be employed to further assist in attaching upper seat 2 to lower support plate 1, and to control the movement of the seat across the lower support plate. Lock plates 6 and 7 may also be located at either end of lower support plate 1 to keep the upper seat on the recessed track. Locking device 8 enhances patient safety and control over movement of seat 2.

In operation, lower support plate 1 is laid across the edge of a bed 9 and the edge of wheelchair seat 10. To transfer from the bed to the wheelchair, the patient sits on upper seat 2. The patient is carried from the bed to the wheelchair as upper seat 2 slides across the top surface of lower support plate 1. Because of the sliding action of the upper seat, the patient requires much less assistance when transferring from one proximate location to another.

Figure 2:
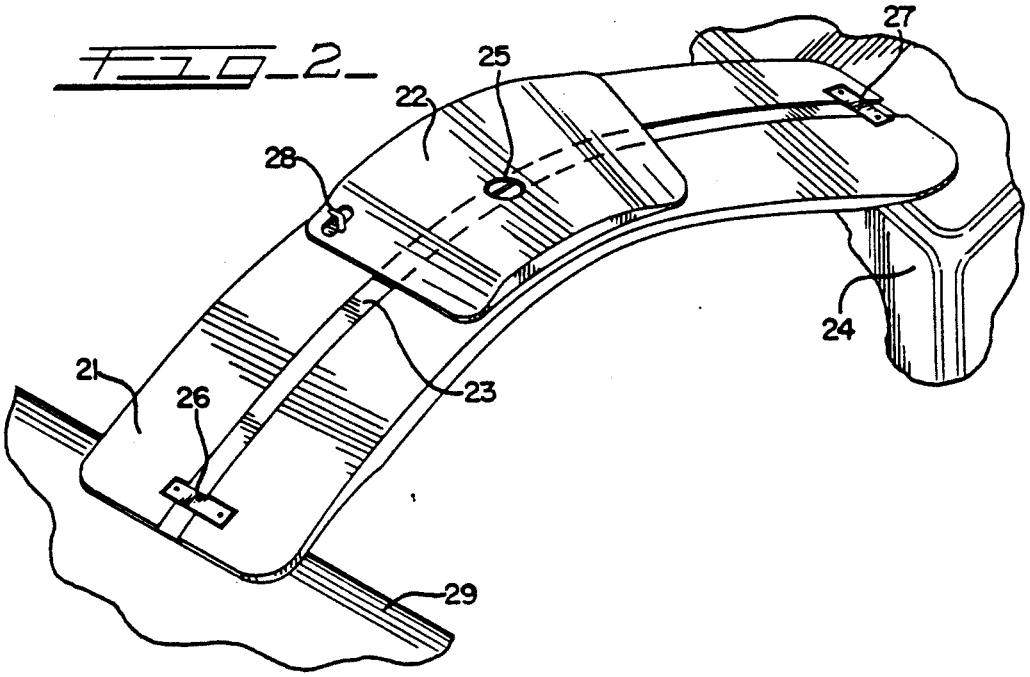
FIG. 2 illustrates a sliding transfer device of the present invention comprising a curved lower support plate.

FIG. 2 illustrates another embodiment of the present invention containing curved lower support plate 21. In this embodiment, curve-shaped upper seat 22 is slidably attached to lower support plate 21 by a guide and track assembly. Track 23 also is curved in accordance with the curvature of lower support plate 21. Adjustable tension screw 25, locking plates 26 and 27, and locking device 28, may also be employed as in the embodiment of FIG. 1.

To transfer a patient from a bed to a wheelchair, one end of the curved lower support plate 21 is placed under the patient at the edge of bed 29, and the other end is placed at the edge of wheelchair seat 24. The patient preferably sits on seat 22 with the patient's back facing the convex portion of the curved lower support plate, and the patient's legs within the convex portion of the lower support plate. The patient is carried from the bed to the wheelchair seat as upper seat 22 slides along the curved path formed by recess track 23. As seat 22 traverses curved track 23, the patient's back is turned toward wheelchair seat 24. Thus, in this embodiment, the patient also requires much less assistance in turning into the sitting position in the wheel chair.

Preferably the lower support plate comprises a long radius arc. However, any arc which would assist in turning the patient into a sitting position may be employed. Furthermore, the curvature on the top surface may be different at different points in the lower support plate. Thus, the curved lower support plate may contain a long radius arc at one end and a short radius arc at the other end. In this manner, the patient would be assisted even further by a sharper turn by the seat plate at the wheelchair seat end.

Figure 3:
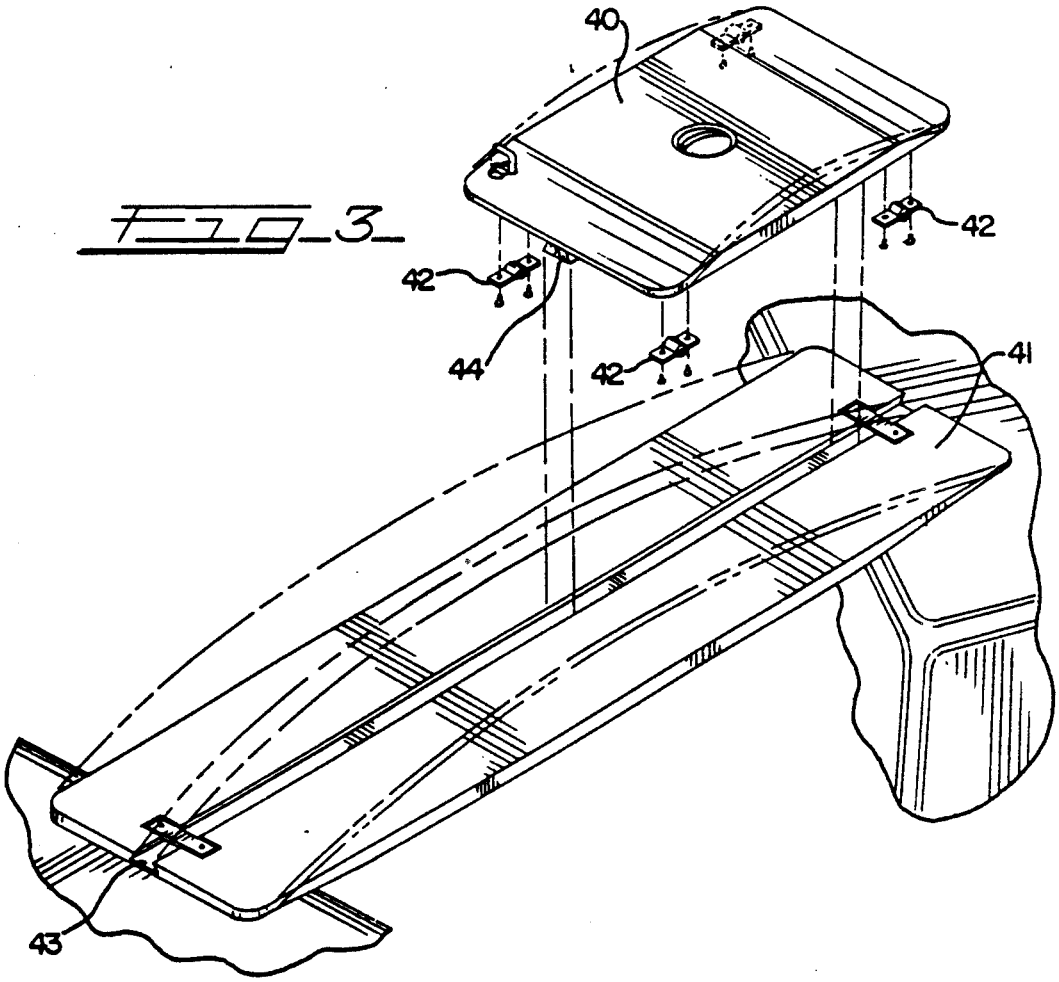
FIG. 3 illustrates an exploded view of a sliding transfer device of the present invention comprising either a substantially rectangular or curved lower support plate.

FIG. 3 is an exploded view of a sliding transfer device of the present invention. In this embodiment, upper seat 40 slidably fits into lower support plate 41 by guide 44 and track 43. Roller wheels 42 may be attached to the bottom of seat 40 to reduce the friction between the seat and the lower support plate. Other means for reducing friction between the upper seat and the lower support plate are contemplated. For example, the recess guide track may be fitted with inside bearings, or the guide attached to the lower portion of the upper seat may be fitted with outside bearings.

The lower support plate and the upper seat may be constructed of any suitable material, including woods, metals such as stainless steel and aluminum, plastics such as nylon or fiberglass, or combinations of these materials. Also, handles may be provided to assist handling of the lower support plate and sliding transfer device.

The seat may be any appropriate shape. Thus, the seat may be cupped in the middle, but flared downwardly at the edges. This configuration will assist the patient to slide onto the device, and prevent clothing or parts of the body from becoming entangled as the seat slides across the lower support plate.

The seat may be attached to the lower support plate by any suitable means. Preferably, the seat is attached by a guide and track arrangement whereby the seat slides across the length of the top surface of the lower support plate. Other sliding mechanisms known to those skilled in the art, however, are also contemplated. Such mechanisms would include, for example, rails, shoulders, rollers, and combinations thereof.

In addition, a belt of approximately 20 to 30 inches may be provided to hold the patient on the seat. Furthermore, handles may be provided at appropriate locations on the seat and the lower support plate to provide balance and safety for the patient.

I claim:

1. A portable sliding transfer device comprising a seat that is adapted to support a human user for movement between one body support, such as a bed, to another body support, such as a wheelchair, said device comprising:

(a) a curved lower support plate having a substantially flat top surface, and (b) an upper seat which is attached to the lower support plate such that the upper seat is slidable over the top surface of the lower support plate.

2. The sliding transfer device of claim 1 wherein the lower support plate comprises a recessed track in the top surface, and the upper seat comprises a guide affixed to the bottom portion of the seat, said guide slidably fitting into the recessed track.

3. The sliding transfer device of claim 1 wherein the upper seat comprises means for reducing the friction between the upper seat and the lower support plate.

4. The sliding transfer device of claim 1 wherein the lower support plate comprises means for reducing the friction between the upper seat and the lower support plate.

5. The sliding transfer device of claim 1 wherein the top surface of the lowerplate comprises more than one curvature.

6. A portable sliding transfer device comprising a seat that is adapted to support a human user for movement between one body support, such as a bed, to another body support, such as a wheelchair, said device comprising:

(a) a curved lower support plate having a substantially flat top surface, (b) a recessed track in the top surface, (c) an upper seat, and (d) a guide affixed to the bottom portion of the upper seat, said guide slidably fitting into the recessed track thereby attaching the upper seat to the lower support plate so that the upper seat is slidable over the top surface of the lower support plate.

* * * * *